US008806810B2

(12) United States Patent
Barragán Olaya

(10) Patent No.: US 8,806,810 B2
(45) Date of Patent: Aug. 19, 2014

(54) FREESTANDING BUILDING MODULE THAT IS PORTABLE AND FOLDABLE AND CAN BE INTER-CONNECTED FOR VERTICAL AND HORIZONTAL EXPANSION

(76) Inventor: Alvaro Alfonso Barragán Olaya, Bogotá (CO)

( * ) Notice: Subject to any disclaimer, the term of this patent is extended or adjusted under 35 U.S.C. 154(b) by 0 days.

(21) Appl. No.: 13/579,557

(22) PCT Filed: Nov. 3, 2010

(86) PCT No.: PCT/IB2010/054981

§ 371 (c)(1),
(2), (4) Date: Aug. 16, 2012

(87) PCT Pub. No.: WO2012/059787

PCT Pub. Date: May 10, 2012

(65) Prior Publication Data

US 2012/0311939 A1 Dec. 13, 2012

(51) Int. Cl.
*E04B 1/344* (2006.01)

(52) U.S. Cl.
USPC ..... 52/79.5; 52/66; 52/69; 52/745.2

(58) Field of Classification Search
CPC ..... E04H 3/126; E04H 15/44; E04H 6/04; E04B 1/3445
USPC ..... 52/64, 66, 68–71, 79.5, 745.02; 446/478
See application file for complete search history.

(56) References Cited

U.S. PATENT DOCUMENTS 2,835,931 A * 5/1958 Sterkin ..... 52/70
3,173,436 A * 3/1965 Peters ..... 52/36.1
3,280,796 A * 10/1966 Hatcher ..... 119/499
3,557,500 A * 1/1971 Schmidt ..... 52/69
3,582,131 A 6/1971 Brown
3,752,349 A * 8/1973 Rana ..... 220/6
3,849,952 A * 11/1974 Hanaoka ..... 52/79.5
3,866,365 A * 2/1975 Honigman ..... 52/70

(Continued)

FOREIGN PATENT DOCUMENTS

CA 2227003 A1 * 7/1999
GB 2172915 A 1/1986
WO WO 02066755 A1 * 8/2002
WO WO 2005/106147 A1 11/2005

OTHER PUBLICATIONS

PCT Search Report or application PCT/IB2010/054981 mailed Jul. 29, 2011.

*Primary Examiner* — Adriana Figueroa
(74) *Attorney, Agent, or Firm* — Alston & Bird LLP

(57) ABSTRACT

The present invention relates to a freestanding architectonic and constructive proposal, produced in the manufacturing facilities, which starting from an interconnectable basic model it can be assembled and reassembled according to specific requirements. Depending on the amount and shapes, it can scale up into horizontal, vertical or both complex architectonic structures. It is a foldable structure which allows easy arrangements for transportation and location in situ. Its configuration is carried through synchronized and symmetric orthogonal rotations and translations, both in its folding phase (1) and its unfolding phase (2), (FIG. 1), executed through any electric, pneumatic, hydraulic or manual system. Each one is integrated by axially symmetric segments forming the cover, the functional wall and the floor. The functional wall can lodge in its frame a typical wall, a functional piece of furniture or incorporate a specialized coupling module.

19 Claims, 13 Drawing Sheets

(56) References Cited

U.S. PATENT DOCUMENTS

| | | | | | |
|---|---|---|---|---|---|
| 4,035,964 | A | * | 7/1977 | Robinson | 52/66 |
| 4,074,475 | A | * | 2/1978 | Wahlquist | 52/70 |
| 4,168,052 | A | * | 9/1979 | Calderaro | 249/188 |
| 4,169,576 | A | * | 10/1979 | Calderaro | 249/188 |
| 4,242,846 | A | * | 1/1981 | Hurd et al. | 52/71 |
| 4,640,544 | A | * | 2/1987 | McNamara et al. | 296/186.4 |
| 4,660,332 | A | * | 4/1987 | Colvin, Jr. | 52/79.5 |
| 4,779,514 | A | * | 10/1988 | Prigmore et al. | 52/79.5 |
| 4,989,379 | A | * | 2/1991 | Suzuki | 52/66 |
| 5,105,589 | A | | 4/1992 | Rodriguez | |
| 5,107,639 | A | * | 4/1992 | Morin et al. | 52/71 |
| 5,313,747 | A | * | 5/1994 | Sakihara | 52/64 |
| 5,622,198 | A | * | 4/1997 | Elsinger | 135/128 |
| 5,966,956 | A | * | 10/1999 | Morris et al. | 62/259.1 |
| 6,434,895 | B1 | * | 8/2002 | Hosterman et al. | 52/143 |
| 7,117,645 | B2 | * | 10/2006 | Bzorgi | 52/79.5 |
| 7,152,614 | B2 | * | 12/2006 | Kalnay | 135/128 |
| 7,647,731 | B2 | * | 1/2010 | Muir | 52/79.5 |
| 2010/0064599 | A1 | * | 3/2010 | Yang et al. | 52/79.5 |
| 2011/0023381 | A1 | * | 2/2011 | Weber | 52/79.5 |
| 2011/0126479 | A1 | * | 6/2011 | Alford et al. | 52/79.5 |
| 2012/0279142 | A1 | * | 11/2012 | Michaud | 52/79.5 |
| 2013/0048522 | A1 | * | 2/2013 | Lorenz et al. | 206/386 |

* cited by examiner

Fig. 3A
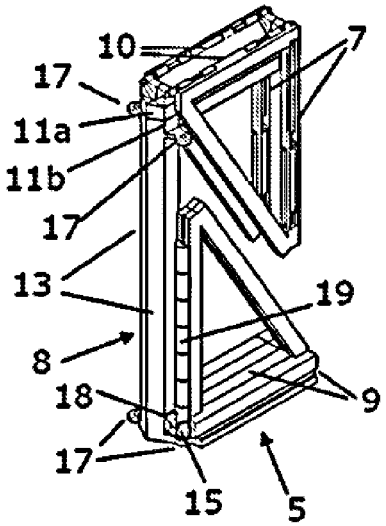
Fig. 3B
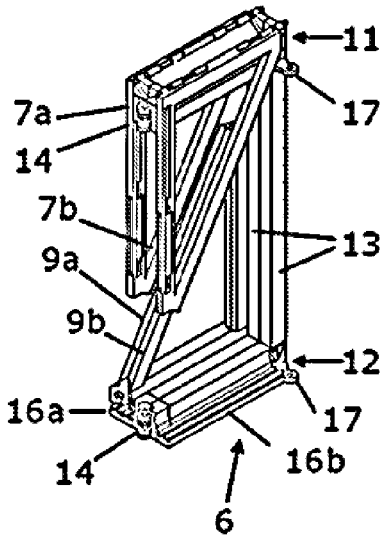
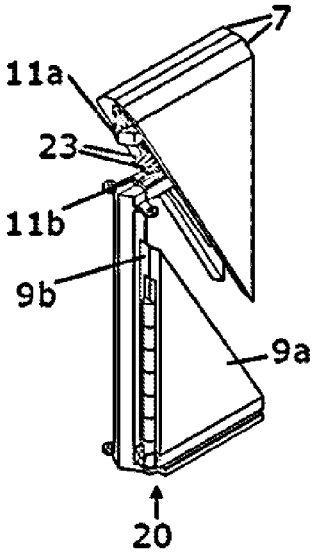
Fig. 4A
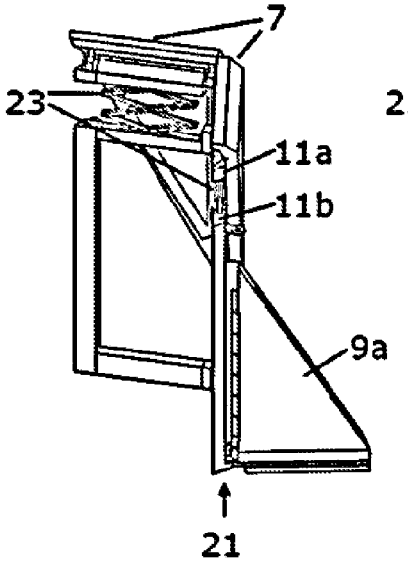
Fig. 4B
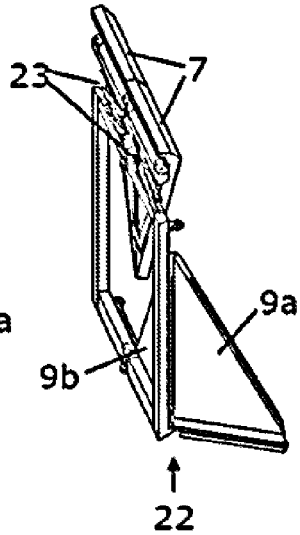
Fig. 4C Fig. 5A
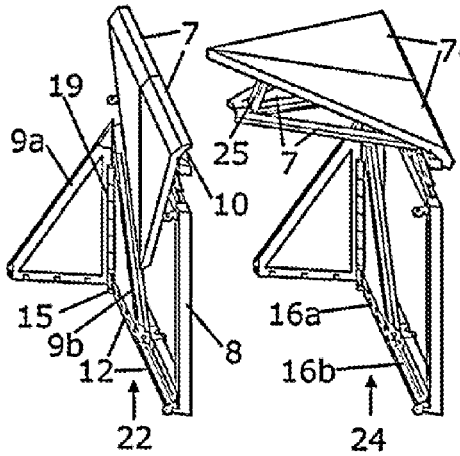
Fig. 5B
Fig. 6A
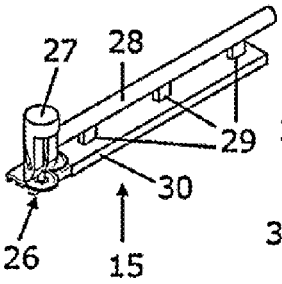
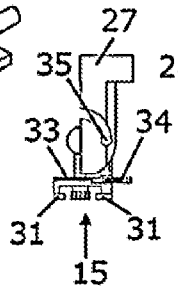
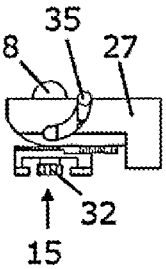
Fig. 6C
Fig. 6B
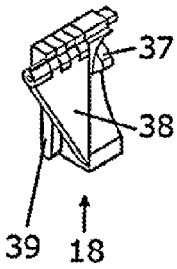
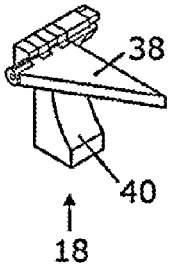
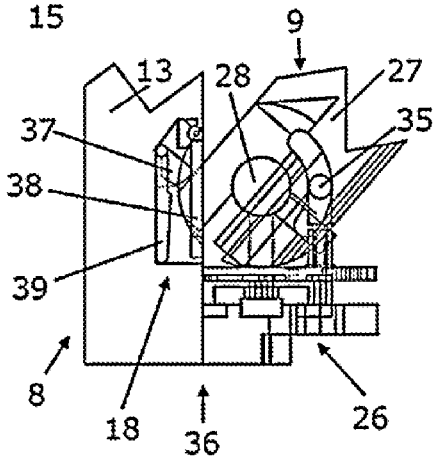
Fig. 7A Fig. 7B Fig. 7C

51

52

53

54

55

56

57

58

59

60

61

62

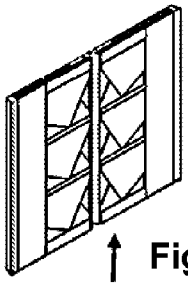
68 Fig. 15A
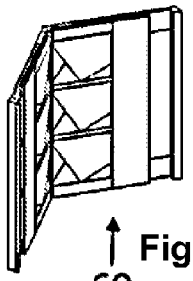
69 Fig. 15B
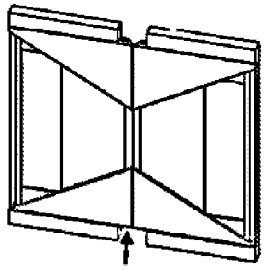
70 Fig. 15C
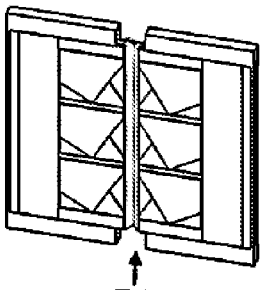
71 Fig. 15D
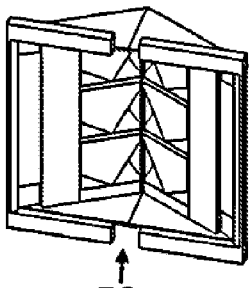
72 Fig. 15E
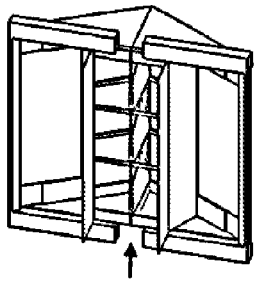
73 Fig. 15F
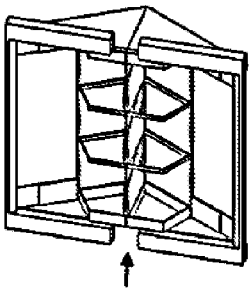
74 Fig. 15G
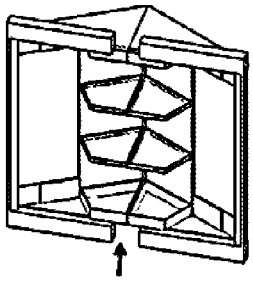
75 Fig. 15H
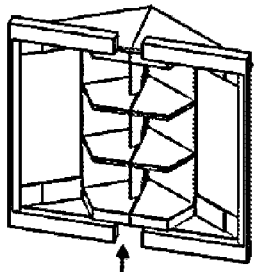
76 Fig. 15I
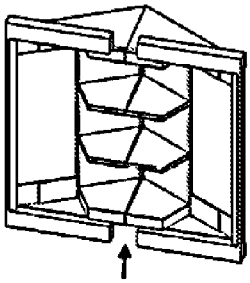
77 Fig. 15J
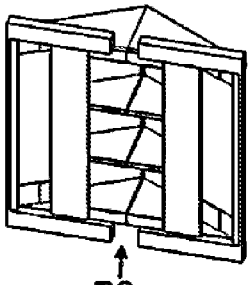
78 Fig. 15K
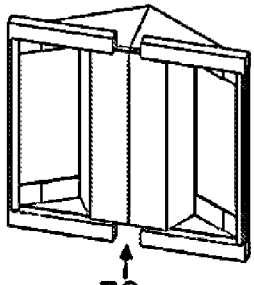
79 Fig. 15L

84

85

86

87

88

89

90

91

92

93

94

95

FREESTANDING BUILDING MODULE THAT IS PORTABLE AND FOLDABLE AND CAN BE INTER-CONNECTED FOR VERTICAL AND HORIZONTAL EXPANSION

CROSS-REFERENCE TO RELATED APPLICATIONS

This application is a national stage application, filed under 35 U.S.C. §371, of International Application No. PCT/IB2010/054981, filed Nov. 3, 2010, the contents of which as is hereby incorporated by reference in its entirety.

TECHNICAL FIELD

The freestanding, portable, folding and interconnectable architectonic module is a versatile constructive and architectonic proposal, which starting from an interconnectable basic model it can be assembles and reassembled according to destination and specific requirements. Thanks to the coupling concept, true complex architectonic structures may be created combining various of these modules in a horizontal, vertical or both arrangement, readdressing the architecture concept and the construction industry. In such concept, the industrial and technological developments, and the strong ecologic trends of the new millennium can converge. Today, mankind is searching for equilibrium between its needs, welfare, comfort, and planet health. This objective is hard to reach if there is not a rethinking and convergence towards unique standards and norms of its habitat. Society is migrating from industrial era to information era, due to science advance, development of new technologies, and the men's ability and capacity for integrate and benefit thereof. Mobility and portability are the main millstones thus breaking space and time paradigms in all community activities.

STATE OF THE ART

Architectonic constructions have been a special, unique and unrepeatable product. It is a result of variables which start in culture and tradition, passing through needs, preferences and environment, and ending in economical, political and social regulations. After evaluating and defining the use requirements, such as: housing, industry, education, health, research, work, marketing, time-out, etc, different processes come into scene including design, engineering, planning, execution, and completion of each project. All under the fundamental premise of minimizing costs overruns due to delays and accidents, derived from lack of specialized labor, raw material availability, climate conditions, transport, etc. Therefore, its evolution has been addressed to developing economic, more efficient, constructive system involving new materials and technologies, including improvement of traditional processes up to assembling parts or semi-manufactured modules which are assembled in-situ, requiring technical labor for mounting and assisting with adequate machinery and tools.

DESCRIPTION

The design of the freestanding, portable, folding and interconnectable architectonic module shown in FIGS. 1A-1B, is based on the reiterative utilization of various Basic Modules which are coupled to each other forming a regular architectonic system, which main purpose is minimizing the space used when being in its fold position 1 and providing the maximum area in its unfolded position 2. This provides a solution to multiple ends thanks to the Specialized Coupling Modules complement which when integrated to the main parts the required specific architectonic system is structured.

Prior to studying its configuration phases from the fold position to its total unfold position, it is important to point out the inherent characteristics of its rotating and translational movements. One is, a vertical displacement, from a height which depends on the design. This characteristic has the following purpose: first, unlocking the freestanding, portable, folding and interconnectable architectonic module when found in the folded position thus allowing the rotation and movements, and second, locking once the final configuration process is reached. This allows a locking status in these two main conditions, adding more rigidity and stability to the system. Another characteristic movement is that one corresponding to horizontal displacements, which are orthogonal, symmetric and synchronized, which is a required action in order to execute its location. Finally, rotating movements independent from translational and necessary for its final configuration and installation.

As symmetry is a typical characteristic, because both through the Basic Module design and the regular shapes obtained thereof, each essential element comprises its two symmetric axial segments, which are identified as only one. In the following paragraphs, when referring to anyone of its two elements, particularly, the letters "a" and "b" shall be used for identification. As to keep the objectivity in the integral explanation, each figure has been organized by the functional unit and its processes. Therein are pointed out these functional units with arrows, and the particular elements with an indicative line.

In order to understand the behavior we will first study the Basic Module and then the freestanding, portable, folding and interconnectable architectonic module as such, and finally some illustrative examples are given, but these examples do not have the purpose of limiting or restricting the scope of the present invention. The freestanding, portable, folding and interconnectable architectonic module taken as an example is a design which provides a hexagonal shaped architectonic solution having an automatic configuration. Thus, it comprises six Basic Modules which are arranged forming sixty degrees angle between each other, once the final position has been reached.

In order to make a simple and clear exposition those details of the complementary elements such as control elements, those generating the required rotation and translation, locking or anchoring devices, as well as the hermetic seal elements for each joint will be obviated, as there are a great number of solutions thereof. In addition, the configuration operations can be executed or performed through any electrical, pneumatic, hydraulic or manual system, depending on the purpose, performance, utilization and costs; which are not the purpose of this description.

FIGS. 2A-2B provide an example of the freestanding, portable, folding and interconnectable architectonic module, showing its structural integrity both in the folded status 3, and unfolded status ready for use 4. The Basic Module offers the freestanding characteristic by integrating a structural part to an external finish part thus obtaining a consistent assembly. In the present description this assembly is taken as one single piece and will refer to its structural part as that one is performing the fundamental role. The external finish will not be taken into account as its only purpose is exclusively esthetic and will only be called when necessary, identified with a letter c. For easiness, the structural part of each element is shown solid but in practice these are reticulated structures.

The Basic Module in its folded status, is shown in FIGS. 3A-3B as a front isometric view 5, and a rear isometric view 6. It comprises three essential elements, which perform their own functions of: cover 7, functional wall 8 and floor 9. Each essential element comprises two axially symmetric parts, which in the case of the functional wall 8 and the floor 9 are coupled and articulated through pivoting hinges, this characteristic allows its contraction into its initial position, forming an angle of 0° between them, or its expansion, forming a specific angle when reaching its final or duty position. The axially symmetric parts of the cover 7, 7*a* and 7*b*, do not bear this characteristic as a vertical displacement of some of these segments is required as was previously explained. The cover 7 and functional wall 8 form an axially pivoting axis through a pivoting hinge 10. The functional wall 8 comprises a top beam 11, a bottom beam 12, and columns 13. This is the functional piece practically supporting all the Basic Module arrangement. The top 11 and bottom 12 beams are conformed by their respective axially symmetric parts, which are articulated by top and bottom pivoting hinges 14, located at their inner end. These pivoting hinges 14 are found height graded in order to allow overlap of its equivalent in the Basic Modules converging when reaching the folded position. Such grading also allows various freestanding, portable, folding and interconnectable architectonic modules to be couples in such cases of multiple configurations.

The top beam 11 acts as a support and rotating element for the cover 7, and is divided in two horizontal sections 11*a* and 11*b* containing in an inner recess a lifting device which cases the vertical displacement of section 11*a*. The bottom beam 12 acts as support and anchoring for floor 9 through a rotating and horizontal displacing element 15, which translational movement performed on a toothed guide 16*a* and 16*b* located on it.

Columns 13 of the functional wall 8 conform external side vertical elements of the Basic Module. Their main function is to articulate along with the related Basic Modules and allow them to rotate due to the pivoting hinges 17 height graded, located qt their top and bottom zone. In the bottom segment of columns 13 there is a complement piece 18 of the floor for design reasons and will be discussed below.

Floor 9 also comprises two axially symmetric parts 9*a* and 9*b*, coupled through a pivoting hinge 19 which holds them together. Due to design needs, a portion of its area has been excluded from its bottom external zone, and has been located in the bottom zone of column 13 of the functional wall 8. This is the complement piece of the floor 18, for two important reasons, first optimizing the space by being located floor 9*a* to a zone apt for that in the related Basic Module maintaining the compactness characteristic of the design. And second because it allows that during the configuration process its rotation and translation are synchronous with the remaining elements of the design. Due to its atypical arrangement it is necessary to introduce a mechanism which performs the work of locating the same in the required place during the configuration of the Basic Module, this is the rotating and horizontal displacing element 15.

Operation

The configuration of both the Basic Module and the freestanding, portable, folding and interconnectable architectonic module is divided in two steps: the first corresponds with its physical positioning, due to translation movements, and the second to the configuration process in its particular structure, due to independent rotating movements.

FIGS. 4A, 4B, and 4C show three positions, initial 20, mid 21 and final 22 of the Basic Module. Positioning of the symmetric parts is done according to the horizontal symmetric displacements which the freestanding, portable, folding and interconnectable architectonic module must do as a whole, which will be discussed below. In the initial position 20 the two axially symmetric segments forming the Basic Module form a core degrees angle. In order to allow free rotations and displacements within the configuration process, before its path is initiated it is necessary to lift the cover 7. As an option in this example, a scissors type of lifter 23 is used, its performance is not explained as this is a technological option. One can clearly see the two horizontal sections 11*a* and 11*b* and its inner recess wherein this lifting device is lodged. Once the translating movement starts, then one can see that the floor segment 9*a* displaces and rotates at the same time with all the structure as seen in 21, due to the movements of the related Basic Module to which it is temporally attached. This process will be better understood when the freestanding, portable, folding and interconnectable architectonic module is analyzed as a whole. When the Basic Module reaches an angle of one hundred and eighty degrees at its final position 22, one can visualize the temporal arrangement of floor 9*a*, which occupies the space which will be used by the segment of floor 9*b* of the related Basic Module in its final position, and forming the angle of sixty degrees with its symmetric part 9*b*, a characteristic of this example.

Once its final position has been reached, the next configuration phase occurs in its inside. FIGS. 5A and 5B show the preparation of cover 7. Cover 7 and the functional wall 8 create an pivoting axis because of the pivoting hinge 10, forming a zero degree angle in its initial position 22, rear view. It is also indicated that the floor segment 9*a* is released from the anchor and reduces its angle formed with segment 9*b* in some degrees, enough as to allow the free displacement of the floor segment 9*b* of the related Basic Module thereafter. This small rotation is done due to the rotating and horizontal displacing element 15. In the final position 24, the structure of the cover 7 forms a ninety degrees angle with respect to the functional wall 8, and the finish part of the cover 7*c* will form a bigger angle with respect to its structure, indicated by the inclination level computed in the design. The mechanism executing this action is the lifting arm 25. Its performance is not considered herein as it is a technological option.

Before we explain the configuration process of floor 9, the two complementary elements involved in said final arrangement will be described.

FIGS. 6A-6C present the rotating and horizontal displacing element 15 in an isometric view and some side views thereof, wherein it can be seen the orthogonal rotation of a coupling element 27, which will transmit both the axial rotation of floor segment 9*a*, in order to located in its position, and the orthogonal rotation in order to fix floor 9 in its end position. One can more clearly distinguish, in the side views, the gear system of the vertical axial rotation 26. The rotating axis 28 and the floor supports 29 are shown, also it can be seen the slipping platform 30 coupled to the bottom beam 12 with the guides 31. The rotating axis 28 and the floor supports 29 are fixed therein. The gear system of the vertical axial rotation 26 comprises three pinions. The rotation generating pinion 32 passing by the toothed guide 16, which must be calibrated in the number of teeth and the distance between them such that when the displacement of floor 9 has ended, the rotation of one hundred and eighty degrees of the floor segment 9*a* has been completed. Pinion 33 is responsible for inverting and transmitting the rotation towards pinion 34, which causes the rotation of the coupling element 27 around the pin axis 35. In the case of floor segment 9*a*, its rotation axis 28 and supports 29 are found free and only fixed to the beam 12*a* once the final position has been reached. Both the referred displacement and orthogonal rotation of floor 9 and the anchoring are provided through mechanisms which are not discussed herein as there are a variety of commercial options.

FIGS. 7A-7C show the other important element, the floor complement piece 18 both in its initial position and final position, and a cross-sectional view 36 which shows clearly the interaction of floor 9 when rotating towards its end position causing the axial displacement of stop 37, which causes the floor portion 38 to rotate when drove by the cam 39. The stop 37 and the cam 39 are axially connected. The whole floor complement 18 is mounted on its base 40.

FIGS. 8A-8C show the positioning of floor 9 with its floor fragment 9*a* rotating around the pivoting hinge 19, towards its final location 41, once vertically placed in the required location 42 and in its final position after its orthogonal rotation 43 occurred.

The configuration process of floor 9 is carried out in two steps. The first step consists in that floor 9 is located in its required position by the action of the rotating and horizontal displacing element 15, thus forming, between the two segments 9*a* and 9*b* an angle of hundred and eighty degrees through the action of the gear system of the vertical axial rotation 26 which transmits this rotation to the coupling element 27, which in turn to the floor segment 9*a*. At this stage, floor 9 remains in a perpendicular position with respect to its normal position. The second step consists in that floor 9 is located now horizontally, in its definite position, through an orthogonal rotation of ninety degrees of the coupling element 27. The complement piece 18 of the floor located in the bottom segment of columns 13 reaches a coplanar position with floor 9.

Once the Basic Module has been analyzed, we proceed with the study of the hexagonal model of the freestanding, portable, folding and interconnectable architectonic module shown in FIGS. 1A-1B, constituted by six Basic Modules interconnected through pivoting hinges 17 located in the upper and lower zones of columns 13 of each one. This example highlights the invariable position of the two outer Basic Modules which due to the design maintain from the beginning the required arrangement of one hundred and eighty degrees between their two axially symmetric parts, and therefore lack of pivoting hinge 14.

Prior to starting the transition sequence, it must be taken into account that in the example under analysis the configuration is carried automatically. There is a variety of possibilities and forms of execution for these movements. In this example, we will take a platform base 44 (FIGS. 9A-9B), which integrates six displacement telescopic arms 45, each one oriented and in this case guided in synchronous manner in order to produce the required orthogonal movements. The formed pair of columns 13 of each one of the related Basic Modules is anchored to its corresponding displacement telescopic arm 45 through an anchoring device 46. The operation of the platform base 44, the displacement telescopic arms 45 and the anchoring devices 46 are not explicitly analyzed because there are different commercial manner for their operation.

In order that the freestanding, portable, folding and interconnectable architectonic module can perform free rotations and displacements, prior to starting its run in some of the Basic Modules, depending on the specific design, it is necessary to lift up their covers a required distance. For a better understanding, the translation sequence of the assembly from an initial position up to its final position, emphasizing the total symmetry conservation, is divided in four phases. The first two positioning phases are shown in the plan view and the other two configuration phases in the isometric views. The first corresponds to a symmetric longitudinal translation for reaching a distance, between the two outer Basic Modules, greater than that required for its final positioning, in order to allow the symmetric segments of the four inner Basic Modules carrying out this process to surpass the restricted angle present in the final location step. FIGS. 10A-10D show some of these temporary positions, starting with its initial position 47, wherein we notice the compactness. At the beginning of the symmetric longitudinal translation, one can observe how the pivoting hinges 14 are being discovered from the functional wall of the inner Basic Modules which were previously overlapped due to their height grading 48. The overlap of covers 7 can be seen in 49, which covers have been lifted thus allowing their positioning without any obstruction. The reached position of the outer Basic Modules in their maximum elongation is shown in 50. The second positioning phase shown in FIGS. 11A-11D, is related to a symmetric transverse translation. The run carried out by the inner Basic Modules to reach their final transverse position is shown in 51 and 52. 53 shows how the restricted angle has been overcame due to the greater longitudinal distance of the outer Basic Modules. In 54, when the latter are contracted, searching for their final positioning, their distances are reduced thus helping to complete the final arrangement of the inner Basic Modules. Now the positioning process of the whole freestanding, portable, folding and interconnectable architectonic module is ended.

FIGS. 12A-12D show phase three corresponding to the configuration of the cover. In 55, once positioning is ended, the arrangement of covers 7 is presented. The next step, 56, is the final location of covers 7 which have remained lifted due to the rotation of the pivoting hinge 10, and the action of the lifting arm 25. Once located, the next step 57 carries out the same operation to the covers 7 which were not lifted. In that position, the preparation process of the fixing and hermetic sealing systems is started, their edges must have overlapping elements, for example, spoilers, which when arriving to their final position fit to cover the joints and thus eliminate the permeability. For this example these will not be studied as there are several methods, forms and mechanisms for obtaining thereof. In step 58, the lifted covers return to their final position thus reaching two important purposes, the hermetic seal and blocking of the whole freestanding, portable, folding and interconnectable architectonic module thus obtaining a integrally rigid and stable structure.

In the last phase shown in FIGS. 13A-13D, the floor configuration is discussed. In order to better understanding covers 7 have been deleted. In step 59, one can observe that the floor symmetric segments 9*a* have been freed from their anchorage in the bottom beam 12 of the related Basic Module which caused its rotation at the same time thereof. Once loose, they rotate thus reducing their aperture angle due to the tense rotation spring located in the coupling element 27, thus obtaining two purposes, first to clear out the path so that the floor 9 can displace itself to its final position in each Basic Module. And locate in its position the gear system of the vertical axial rotation 26. Both the attaching element and the tense rotation spring are not discussed in connection with their function as there are several commercial options available. In step 60, it can be seen the location of floor 9 arriving to its final position thanks to the rotating and horizontal displacing element 15 and its gear system of the vertical axial rotation 26. In step 61, the position of floor 9 in its place and completely extended is presented, at that moment the preparation process of the fixing and hermetic sealing systems starts. In step 62, due to the orthogonal rotation of the coupling element 27, the system as a whole acquires its final position including the floor complementary piece 18.

Up to now, the fundamental configuration of the freestanding, portable, folding and interconnectable architectonic module has been studied, which is used for conforming complex architectonic structures. From here on we will discuss one of its strengths, the functional wall 8, previously discussed concerning its structural part. Such function is offered by a system contained in the frame formed by its beams 11 and 12, and columns 13. Its arrangement process is started once the freestanding, portable, folding and interconnectable architectonic module is on its final position. The options presented in FIGS. 14A-14D, as examples, do not limit the diverse possibilities which can be obtained. The configuration process will be discussed later on below taking one of these options as a sample. Also, for clearness commercial devices used for rotation, translation, retention and anchoring will not be further discussed as are not an interest of the present discussion. In step 63, a typical wall is taught. In step 64, discloses a wall with an integrated piece of furniture. In step 65, another wall model with integrated piece of furniture is disclosed. And step 66 discloses an example of the Specialized Coupling Module, which has the purpose of serving as a container or storage device, comprising particular elements and equipment, including electric, hydraulic, heating, control, surveillance, security services and facilities, etc, which once being coupled to the freestanding, portable, folding and interconnectable architectonic module offer the optimum solution to any demand. These are integrated to the functional wall 8 according to the requirements and uses of the model. They bear the quality of being retractable, their sections 67 are displaced outwardly, freeing the required space in their inside.

FIGS. 15A-15L show, as can be seen, in a particular example, the way in which the furniture function is arranged. This is formed by two expandable symmetrical racks. The expandable rack is in turn constituted by two panels, one inner panel which supports the shelves, the covers and doors of the furniture and displace on rails on the other outer panel which contains it and which supports the windows. In the outer central zone there is an articulation and rotation element, a pivoting hinge, which joins the two expandable racks. There are other two pivoting hinges, at their ends, which anchor these racks to the structural wall 8. In their initial position 68 their parts form an angle of one hundred and eighty degrees in the same plane of the structural wall 8. In the first configuration phase the central pivoting hinge is displaced towards the outside 69, thus reaching its final position. In the previous views the structural wall 8 has been deleted, in order to obtain a total panorama. In 70 and 71, it can be seen an initial isometric view of the wall furniture on its outer and inner face, respectively. When the furniture carries out its translational movement, two important actions take place. On one hand, the top and lower covers rotate in order to locate in their horizontal position, and on the other hand, the expandable racks retreat until their final prolongation thus locating the shelves in their position and exposing the area corresponding to the windows, 72. Further on, the supports of the shelves are located along with the side covers, 73. In 74, the side covers and doors have been deleted from the isometric view, in order to clearly expose the arrangement of the shelves. In 75, the upper and lower covers of the shelves have been deleted to show the shelve supports in their definite position. In 76, the upper covers of the shelves have been fixed and then the lower covers, 77. In 78, the furniture is shown completely assembled with the doors open, and in 79, the furniture is shown with the front face closed. The shelves, covers and doors are articulated with hinges.

Now that the hexagonal freestanding, portable, folding and interconnectable architectonic module has been completely analyzed as an example, in FIGS. 16A-16D, other exploitation possibilities are taught under the same concept. In 80, an assembly with a conventional wall face is taught. In 81, another furniture model is used. In 82 and 83, some models with Specialized Coupling Modules are shown.

Another of the strengths of the freestanding, portable, folding and interconnectable architectonic module is its versatility for scaling in more complex architectonic structures, by selecting not only the amount but the shape of these Modules. Its shape derives from its regular symmetry characteristic and according to the number of Basic Modules being used. Non-limitative examples are shown in FIGS. 17A-17F, such as a triangular model 84, quadrangular model 85, pentagonal model 86, hexagonal model 87, heptagonal model 88 and octagonal model 89.

The Best Way to Carry it Out and Where Can it Be Applied

The freestanding, portable, folding and interconnectable architectonic module is a folding structure easy to be arranged for transporting and locating in situ. the simple preparation and arrangement done under basic instructions, including automation, using a computer or a microcontroller, allows executing a determined sequence of rotations and translations both during the folding phase and the unfolding phase. Such movements are made with any electrical, pneumatic, hydraulic or manual system, depending on the purpose, performance, use and costs.

The freestanding, portable, folding and interconnectable architectonic module can be an alternative to lots of construction needs of today's world: Due to its variety of applications and configurations, by offering reasonable, efficient, secure and comfortable spaces. Due to its low construction costs, allowing, during manufacturing, the inclusion of related systems such as hydraulic, electric, control, etc., integrated as a functional unit, under a series production thus favoring scale economy, minimizing overcosts and delays. Due to its easiness for being repaired and maintained, its configuration starts with a repeating Basic Module, formed by a set of essential pieces, according to requirements. Due to its efficiency which allows the use of reusable materials for its structural component, such as: biodegradable polymers, composites, light steels, aluminums, etc., thus guaranteeing a good thermal and acoustic isolation, and great physical and chemical resistance to environment. Due to its portability and mobility, being one solid, stacking and low weight assembly makes it easy for transporting and fast mounting thereof. Due to its flexibility while being reconfigurable and expandable thanks to its modular conception and its scaling into more complex architectonic structures, being able to integrate equipments and solutions for a specific destination such as: emergency housing in great disasters, hospitals and movable care centers, research centers located in wild places, definite housing options for rehabilitation or immediate development zones both in land or water, rural schools and libraries, production and gathering centers, application in space stations and explorations, in promotion and publicity campaigns and programs, moving homes and recreational vehicles, and in endless possibilities. The freestanding, portable, folding and interconnectable architectonic module can be folded and stored in a construction provided underground which will maintain the same safe from hurricanes or monsoons. It can be maintained over the water when sustained on a floating platform, in case of flooding, support strong telluric movements when anti-oscillating elements are added to its structure. The cities of the future vertically developed find an option as this system is totally modular, structurally strong and has low weight, integrally constructed in facilities and easy to transport to the required location.

FIGS. 18A-18F show examples of scaling into complex structures in horizontal and vertical developments. 90 refers to an isometric view, and 91 refers to a plant view, which show a model developed with three hexagonal freestanding, portable, folding and interconnectable architectonic modules and six triangular thereof. 92 refers to an isometric view, and 93 refers to a plant view, which show a model developed with seven hexagonal freestanding, portable, folding and interconnectable architectonic modules. 94 and 95 present a multi-level solution having a configuration of three hexagonal freestanding, portable, folding and interconnectable architectonic modules in each level, 94 shows the receptacle structure and 95 the finished solution.

BRIEF DESCRIPTION OF THE FIGURES

FIGS. 3A-3B. Front and rear Isometric views of the structure of the Basic Module in its folded status.

FIGS. 4A-4C. Arrangement of the Basic Module in its typical steps.

FIGS. 5A-5B. Configuration of the cover of the Basic Module.

FIGS. 6A-6C. Isometric and side views describing the horizontal displacement and rotating element.

FIGS. 7A-7C. Isometric and cross-sectional views of the positioning describing the complement piece of the floor.

FIGS. 15A-15L. Example of a typical configuration of a furniture integrated with a functional wall.

Figure 1A:
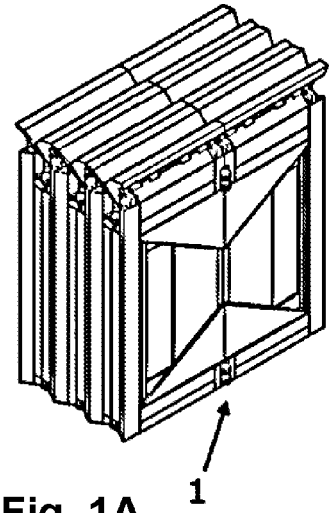
FIGS. 1A-1B. The freestanding, portable, folding and interconnectable architectonic module taken as an example, shown in its initial and final status.
Figure 1B:
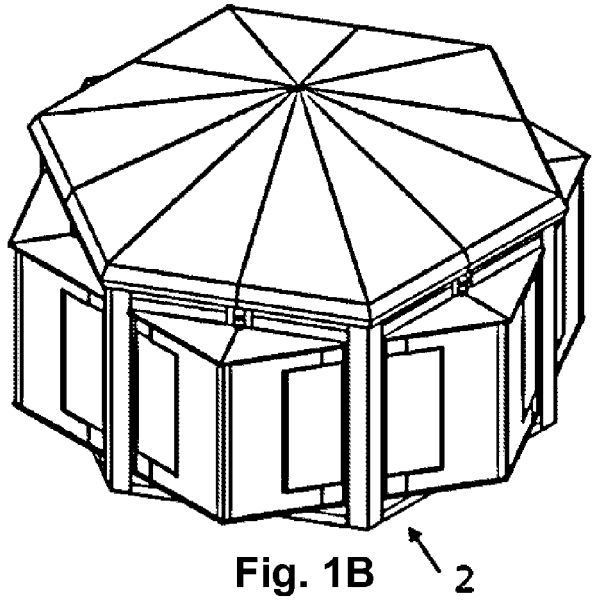
Figure 2A:
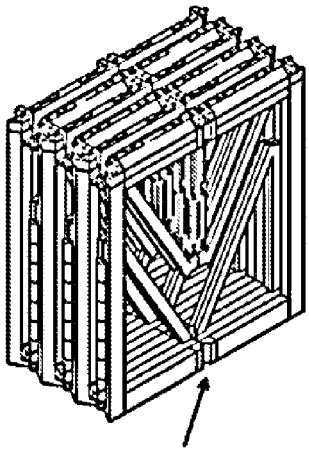
FIGS. 2A-2B. The structure of the freestanding, portable, folding and interconnectable architectonic module taken as an example, shown in its initial and final status.
Figure 2B:
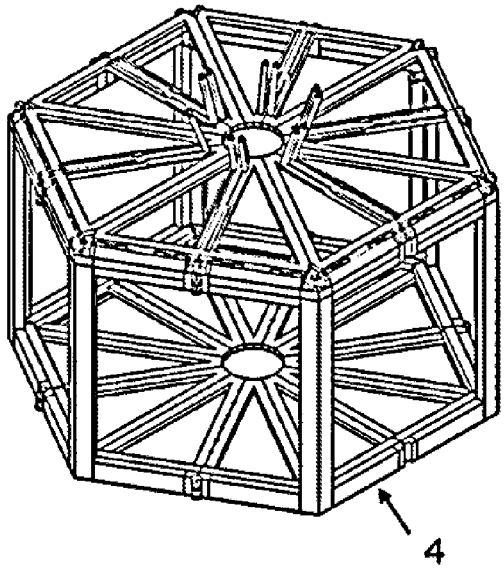
Figure 8A:
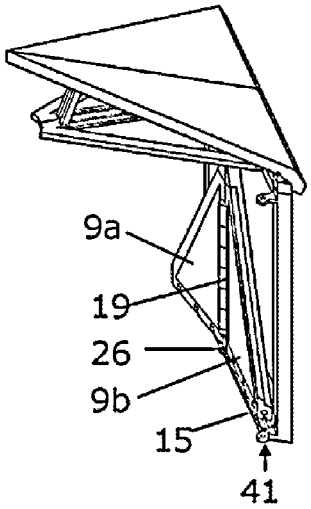
FIGS. 8A-8C. Configuration of the floor of the Basic Module.
Figure 8B:
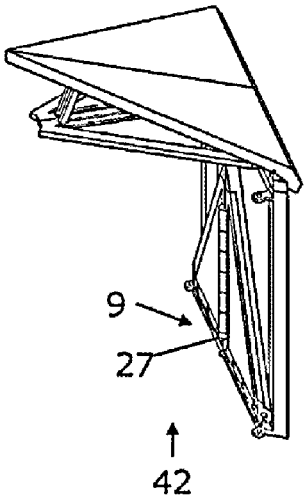
Figure 8C:
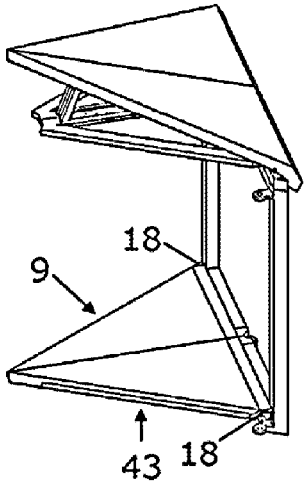
Figure 9A:
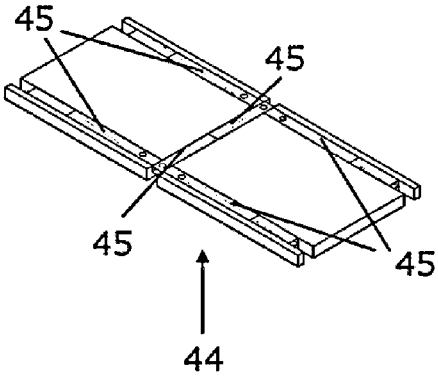
FIGS. 9A-9B. Arrangement of the platform base and arrangement of the displacement telescopic arms.
Figure 9B:
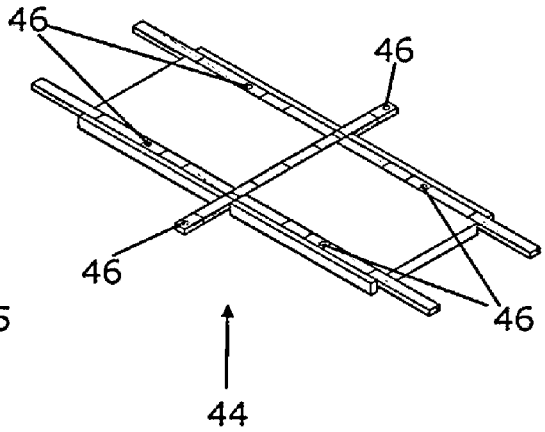
Figure 10A:
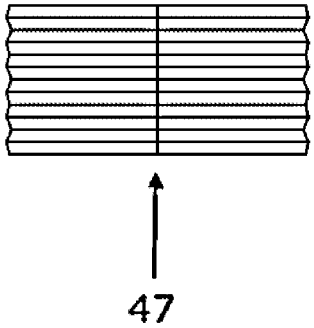
FIGS. 10A-10D. Arrangement of the freestanding, portable, folding and interconnectable architectonic module during the symmetric longitudinal translation.
Figure 10B:
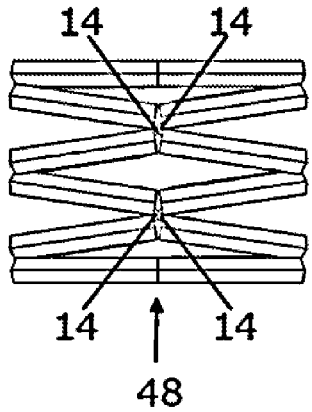
Figure 10C:
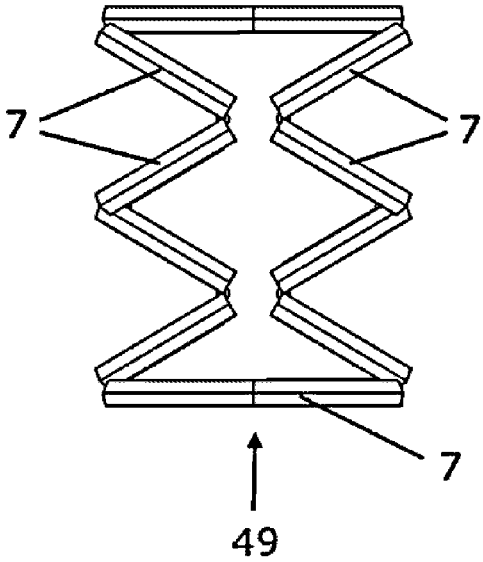
Figure 10D:
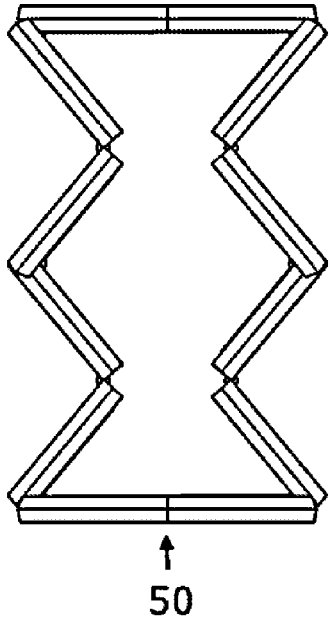
Figure 11A:
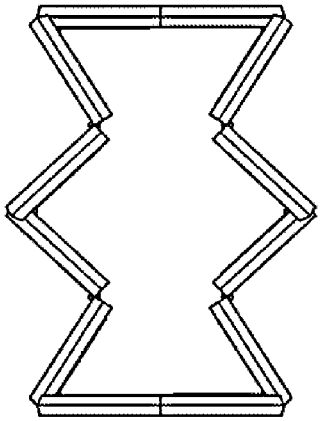
FIGS. 11A-11D. Positioning of the freestanding, portable, folding and interconnectable architectonic module during the symmetric longitudinal translation.
Figure 11B:
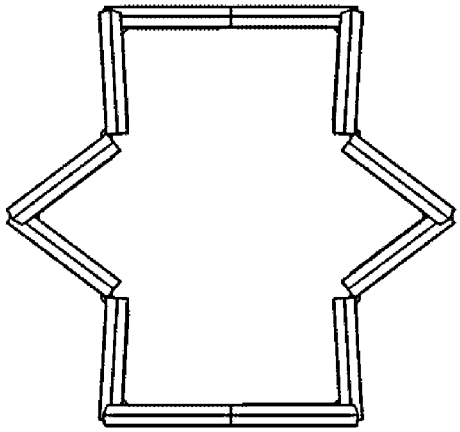
Figure 11C:
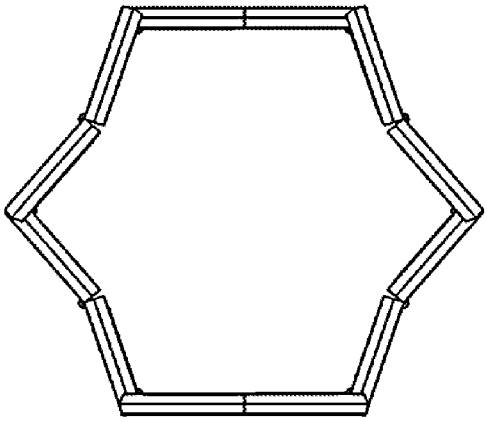
Figure 11D:
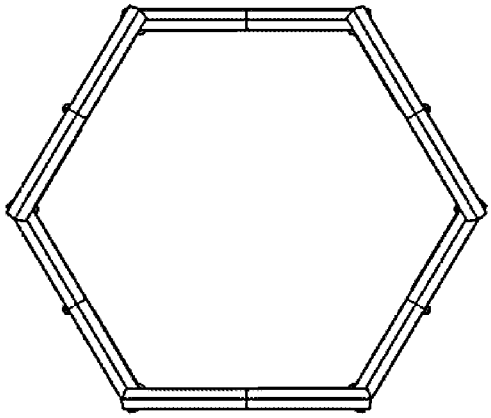
Figure 12A:
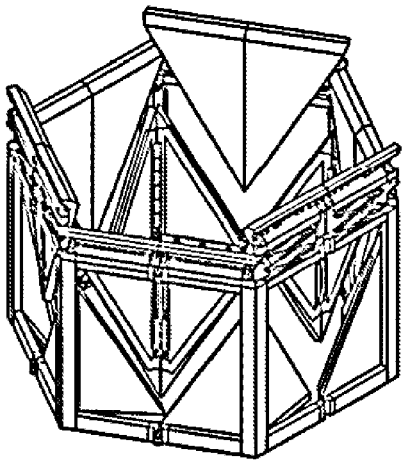
FIGS. 12A-12D. Configuration of the cover of the freestanding, portable, folding and interconnectable architectonic module.
Figure 12B:
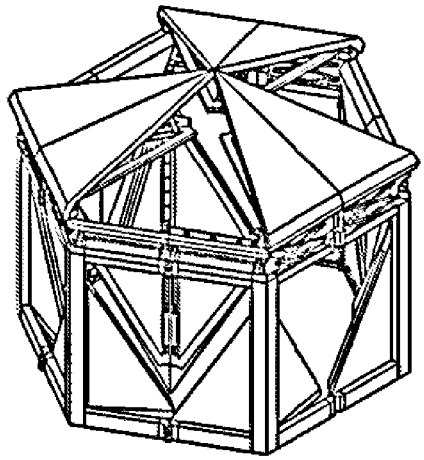
Figure 12C:
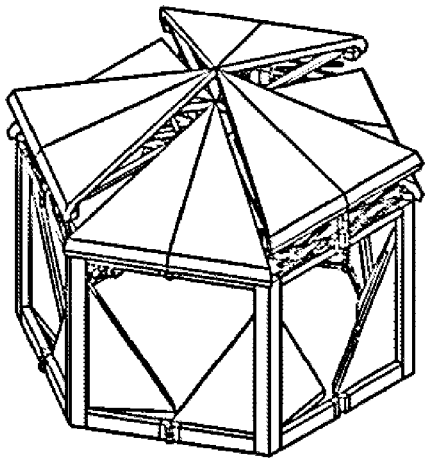
Figure 12D:
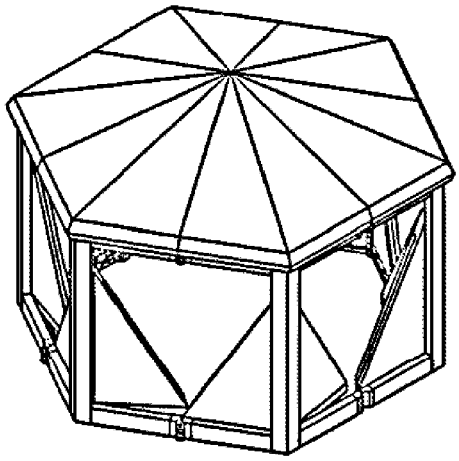
Figure 13A:
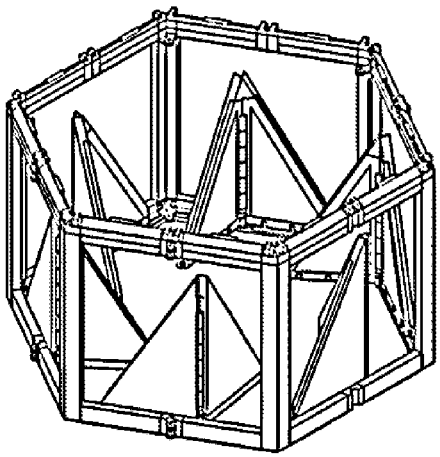
FIGS. 13A-13D. Configuration of the floor of the freestanding, portable, folding and interconnectable architectonic module.
Figure 13B:
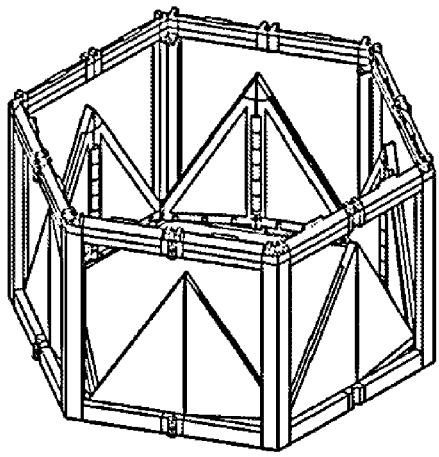
Figure 13C:
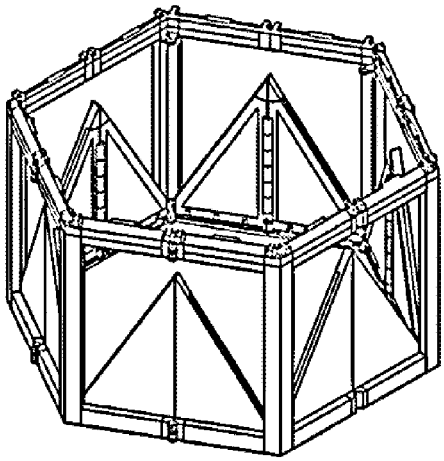
Figure 13D:
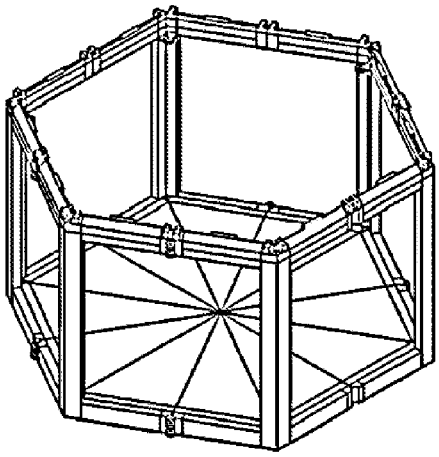
Figure 14A:
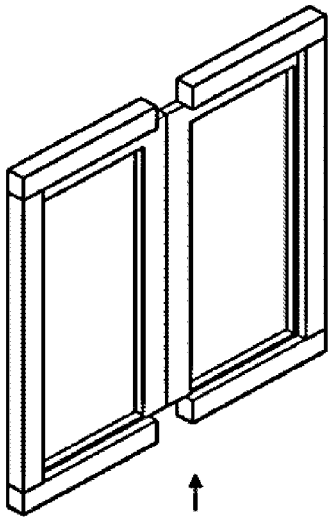
FIGS. 14A-14D. Examples of configurations of the functional wall with integrated piece of furniture and with Specialized Coupling Module.
Figure 14B:
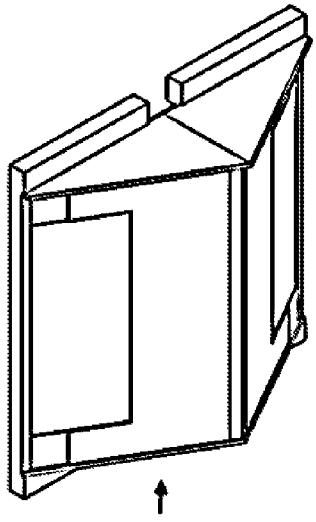
Figure 14C:
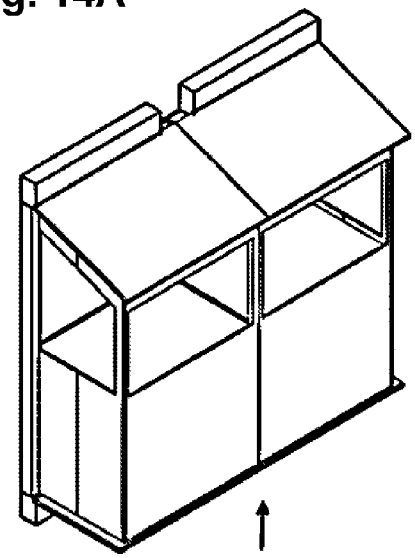
Figure 14D:
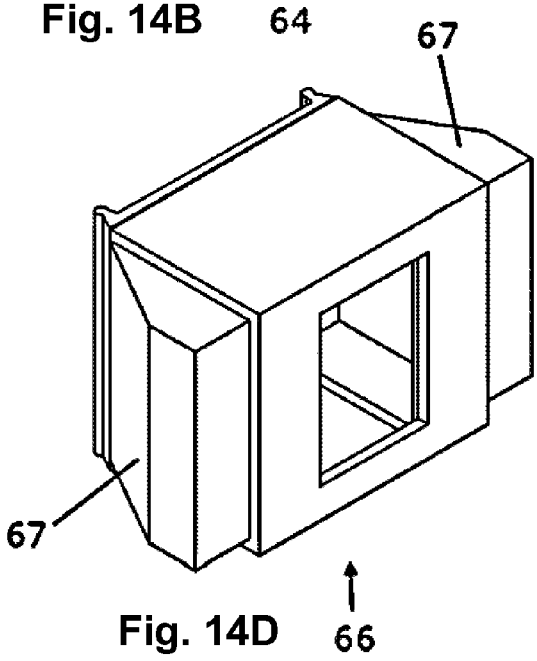
Figure 16A:
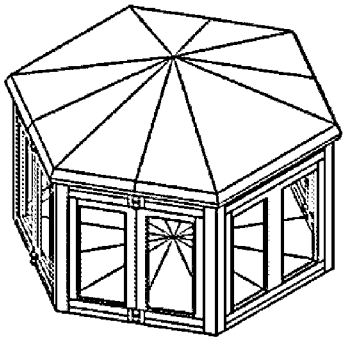
FIGS. 16A-16D. Examples of models of functional configuration of the freestanding, portable, folding and interconnectable architectonic module.
Figure 16B:
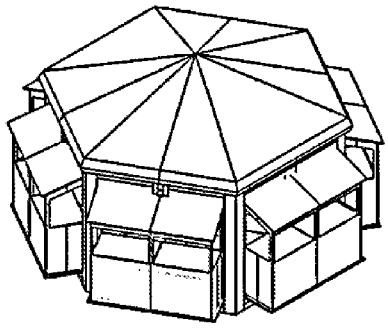
Figure 16C:
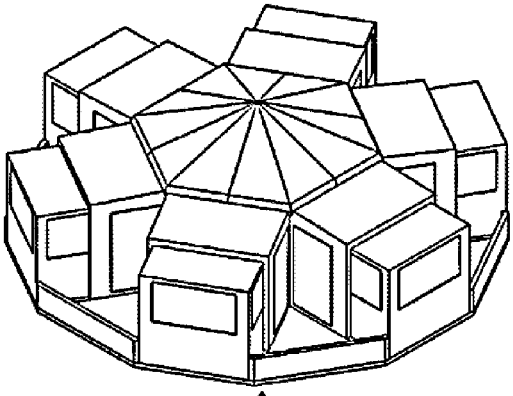
Figure 16D:
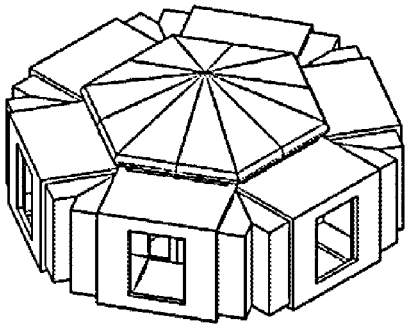
Figure 17A:
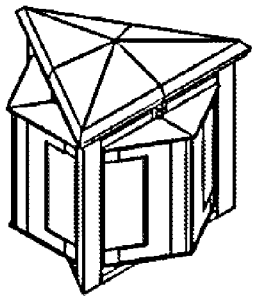
FIGS. 17A-17F. Examples of regular models of the freestanding, portable, folding and interconnectable architectonic module.
Figure 17B:
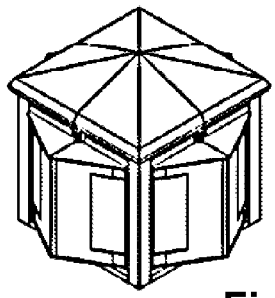
Figure 17C:
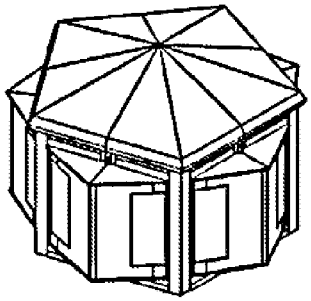
Figure 17D:
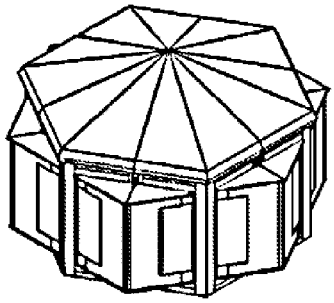
Figure 17E:
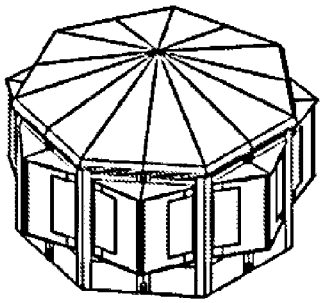
Figure 17F:
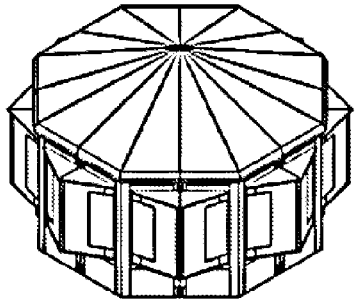
Figure 18A:
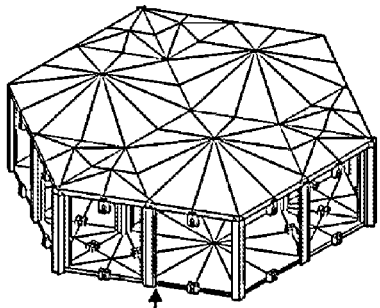
FIGS. 18A-18F. Examples of horizontal and vertical scalability of the freestanding, portable, folding and interconnectable architectonic module.
Figure 18B:
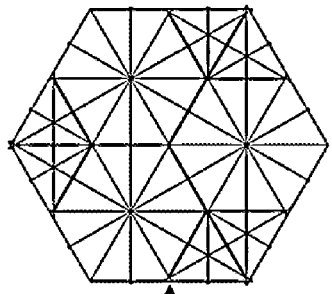
Figure 18C:
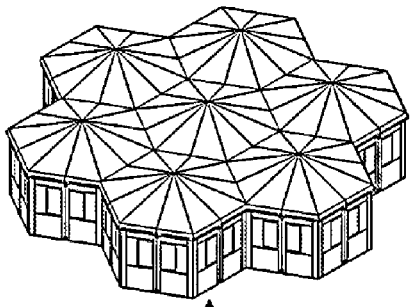
Figure 18D:
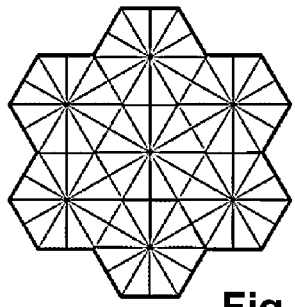
Figure 18E:
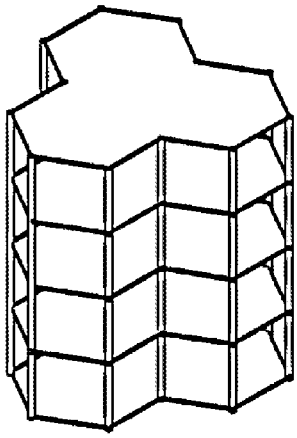
Figure 18F:
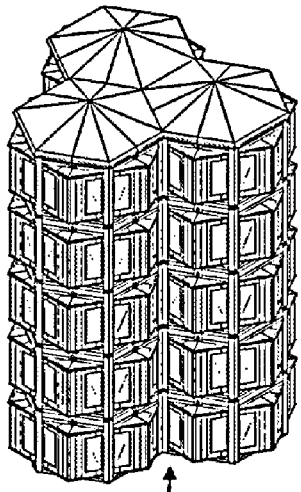

The invention claimed is:

1. A portable freestanding, foldable, and interconnectable architectonic module that is horizontally and vertically extendible via two or more freestanding basic sub-modules, each basic sub-module comprising:

a cover (7) comprising a first cover part (7*a*) and a second cover part (7*b*);

a floor (9) comprising a first floor part (9*a*) and a second floor part (9*b*); and a wall (8) comprising a top beam (11) and a bottom beam (12), wherein:

the basic sub-modules further comprise columns (13) having pivoting hinges (17) adjacent a top part of the columns (13) and adjacent a bottom part of the columns (13), so as to enable rotation of the columns so as to provide articulation thereof along with the related basic sub-modules;

the top beam (11) is defined by a first top beam part (11*a*) and a second top beam part (11*b*), the first and second top beam parts (11*a*, 11*b*) being axially symmetric relative to one another and about at least one top beam pivoting hinge (14) located at an inner end of the top beam (11), the top beam pivoting hinge (14) being configured so as to provide a pivoting connection between respective ends of the first and second top beam parts (11*a*, 11*b*);

the first and second cover parts (7*a*, 7*b*) are operatively connected to at least the first and second top beam parts (11*a*, 11*b*) via at least one pivoting hinge (10) extending along a length of the first and second top beam parts (11*a*, 11*b*), such that the first and second cover parts (7*a*, 7*b*) are axially symmetric relative to one another about the top beam pivoting hinge (14) and an axial rotation axis is defined between the cover (7) and the wall (8) by the pivoting hinge (10);

the bottom beam (12) is defined by a first bottom beam part (12*a*) and a second bottom beam part (12*b*), the first and second bottom beam parts (12*a*, 12*b*) being axially symmetric relative to one another and about at least one bottom beam pivoting hinge (14) located at an inner end of the bottom beam (12), the bottom beam pivoting hinge (14) being configured so as to provide a pivoting connection between respective ends of the first and second bottom beam parts; and the first and second floor parts (9*a*, 9*b*) are axially symmetric relative to one another about at least one common pivoting hinge (19).

2. The architectonic module of claim 1, wherein a standard wall including its lighting and vent element (63) is affixed to at least a portion of at least one of the top beam (11), the bottom beam (12), or the column (13) of the wall (8).

3. The architectonic module of claim 1, wherein a system of folded furniture (64, 65), formed by expandable symmetric frames, is affixed via pivoting hinges to at least a portion of at least one of the top beam (11), the bottom beam (12), or the column (13) of the wall (8).

4. The architectonic module of claim 1, wherein a specialized service coupling module (66), with lighting and vent elements, is affixed to at least a portion of at least one of the top beam (11), the bottom beam (12), or the column (13) of the wall (8).

5. The architectonic module of claim 4, wherein the specialized service coupling module (66) comprises one or more sections (67) configured for outwardly displacement relative to at least a portion of at least one of the top beam (11), the bottom beam (12), or the column (13) of the wall (8).

6. The architectonic module of claim 1, wherein the cover (7) forms a ninety degree angle with respect to the wall (8) and a finishing portion of the cover (7*c*) forms an angle equal to or greater than ninety degrees with respect to the wall (8).

7. The architectonic module of claim 1, wherein the hinges (14) of each basic sub-module are interspersed in the wall (8), so as to allow the overlapping of equivalent or corresponding opposed hinges (14) of two or more respectively adjacent basic sub-modules.

8. The architectonic module of claim 1, further comprising a horizontal displacement and rotation element (15), wherein the element (15) comprises:

a toothed guide (16);
a plurality of vertical axial rotation pinions (26);
a coupling element (27)
a rotation generating pinion (32);
a pinion (33);
a pinion (34); and
a pin axis (35),
wherein:
the rotation generating pinion (32) passes by the toothed guide (16);
the pinion (33) is configured for inverting and transmitting rotation towards the pinion (34), so as to cause rotation of the coupling element (27) around the pin axis (35); and
the coupling element (27) transmits both an axial rotation and an orthogonal rotation upon the first floor part (9*a*), such that the element (15) is configured to apply a displacement force and a rotational force upon the floor (9), at least the displacement force being provided via the toothed guide (16) thereof.

9. The architectonic module of claim 8, further comprising a slipping platform (30) coupled to the bottom beam (12) via one or more guides (31), wherein at least a portion of the second floor part (9*b*) is fixed to the slipping platform (30).

10. The architectonic module of claim 9, wherein:
a rotating axis (28) and supports (29) of the second floor part (9*b*) are fixed to the slipping platform (30); and
supports (29) of the first floor part (9*a*) are freely movable prior to reaching a final configuration of the architectonic module.

11. The architectonic module of claim 1, further comprising a floor complement piece (18) that is mounted on its base (40) and is positioned via movement of the floor (9) by axial displacement of a stop (37) that causes rotation of floor portion (38) and a cam (39) that pushes the floor portion (38).

12. The architectonic module of claim 3, wherein the folded furniture system (64, 65) comprises components such as shelves, covers, doors, and other elements attached to expandable symmetric racks.

13. The architectonic module of claim 4, wherein the specialized services coupling module (66) comprises at least one of control, surveillance, or security services; or electric, hydraulic, or heating services.

14. The architectonic module of claim 1, wherein the module is in a folded status (1), whereby the module may be unfolded into an unfolded status (2) in an automatic manner.

15. The architectonic module of claim 14, wherein folding or unfolding of the module in an automatic manner is via at least one of an electric, pneumatic, or hydraulic system.

16. An assembly comprising two or more of the architectonic modules of claim 1, wherein the assembly is formed by at least one of horizontally or vertically positioning at least one of the two or more of the architectonic modules adjacent one another or combining two or more basic sub-modules into two or more sub-assemblies adjacent one another.

17. A method for configuring the architectonic module of claim 1, the method comprising the steps of:
imposing a symmetric longitudinal translation upon the module until reaching a maximum elongation, so as to move the symmetric parts of the module to surpass a restricted angle, the restricted angle corresponding to an unfolded configuration;
imposing a symmetric transverse translation upon the module until the symmetric parts of the module return to the restricted angle;
folding the first and second cover parts (7*a*, 7*b*) of the cover (7) so as to block the architectonic module;
releasing the first floor part (9*a*) from an anchorage and imposing movement thereon to reduce an angle formed between the first floor part (9*a*) and the second floor part (9*b*), so as to allow free displacement of the second floor part (9*b*) of the adjacent module;
configuring the floor (9), wherein said configuring comprises the steps of:
moving the floor (9) into an unfolded configuration through a horizontal displacement and a rotation, thus forming a one hundred and eighty degree angle between the first and the second floor parts (9*a*, 9*b*) in a perpendicular position with respect to its normal; and
horizontally locating the floor (9) into its definite position via imposing an orthogonal rotation of ninety degrees upon the floor (9).

18. The method of claim 17, further comprising a folding procedure, said procedure comprising a reverse execution of the steps of claim 17 following initial execution thereof.

19. A method for configuring the architectonic module, the method comprising the steps of:
providing at least two or more freestanding basic sub-modules, each basic sub-module comprising:
a cover (7) comprising a first cover part (7*a*) and a second cover part (7*b*);
a floor (9) comprising a first floor part (9*a*) and a second floor part (9*b*); and
a wall (8) comprising a top beam (11) and a bottom beam (12),
wherein:
the basic sub-modules further comprise columns (13) having pivoting hinges (17) adjacent a top part of the columns (13) and adjacent a bottom part of the columns (13), so as to enable rotation of the columns so as to provide articulation thereof along with the related basic sub-modules;
the top beam (11) is defined by a first top beam part (11*a*) and a second top beam part (11*b*), the first and second top beam parts (11*a*, 11*b*) being axially symmetric relative to one another and about at least one top beam pivoting hinge (14) located at an inner end of the top beam (11), the top beam pivoting hinge (14) being configured so as to provide a pivoting connection between respective ends of the first and second top beam parts (11*a*, 11*b*);
the first and second cover parts (7*a*, 7*b*) are operatively connected to at least the first and second top beam parts (11*a*, 11*b*) via at least one pivoting hinge (10) extending along a length of the first and second top beam parts (11*a*, 11*b*), such that the first and second cover parts (7*a*, 7*b*) are axially symmetric relative to one another about the top beam pivoting hinge (14) and an axial rotation axis is defined between the cover (7) and the wall (8) by the pivoting hinge (10);

the bottom beam (12) is defined by a first bottom beam part (12*a*) and a second bottom beam part (12*b*), the first and second bottom beam parts being axially symmetric relative to one another and about at least one bottom beam pivoting hinge (14) located at an inner end of the bottom beam (12), the bottom beam pivoting hinge (14) being configured so as to provide a pivoting connection between respective ends of the first and second bottom beam parts; and the first and second floor parts (9*a*, 9*b*) are axially symmetric relative to one another about at least one common pivoting hinge (19);

imposing a symmetric longitudinal translation upon the module until reaching a maximum elongation, so as to move the symmetric parts of the module to surpass a restricted angle, the restricted angle corresponding to an unfolded configuration;

imposing a symmetric transverse translation upon the module until the symmetric parts of the module return to the restricted angle;

folding the first and second cover parts (7*a*, 7*b*) of the cover (7) so as to block the architectonic module;

releasing the first floor part (9*a*) from an anchorage and imposing movement thereon to reduce an angle formed between the first floor part (9*a*) and the second floor part (9*b*), so as to allow free displacement of the second floor part (9*b*) of the adjacent module; and configuring the floor (9), wherein said configuring comprises the steps of:

moving the floor (9) into an unfolded configuration through a horizontal displacement and a rotation, thus forming a one hundred and eighty degree angle between the first and the second floor parts (9*a*, 9*b*) in a perpendicular position with respect to its normal; and horizontally locating the floor (9) into its definite position via imposing an orthogonal rotation of ninety degrees upon the floor (9).

* * * * *